US008882604B2

(12) United States Patent
Lochtefeld

(10) Patent No.: US 8,882,604 B2
(45) Date of Patent: Nov. 11, 2014

(54) FLOW DIVIDER FOR SHEET FLOW WATER RIDES

(71) Applicant: Thomas J. Lochtefeld, La Jolla, CA (US)

(72) Inventor: Thomas J. Lochtefeld, La Jolla, CA (US)

(73) Assignee: Surf Park Pte, Ltd., Singapore (SG)

( * ) Notice: Subject to any disclaimer, the term of this patent is extended or adjusted under 35 U.S.C. 154(b) by 5 days.

(21) Appl. No.: 13/683,790

(22) Filed: Nov. 21, 2012

(65) Prior Publication Data

US 2013/0130815 A1 May 23, 2013

Related U.S. Application Data

(60) Provisional application No. 61/563,265, filed on Nov. 23, 2011.

(51) Int. Cl.

| | |
|---|---|
| ***A63G 21/18*** | (2006.01) |
| ***A63B 69/00*** | (2006.01) |
| ***A63G 31/00*** | (2006.01) |
| *A63G 21/00* | (2006.01) |
| *E04H 4/00* | (2006.01) |

(52) U.S. Cl.

CPC ..... *A63G 31/007* (2013.01); *A63B 69/0093* (2013.01); *A63B 2208/03* (2013.01); *E04H 4/0006* (2013.01)

USPC ..... 472/117; 472/128

(58) Field of Classification Search

CPC ..... A63G 3/00; A63G 3/02; A63G 21/00; A63G 21/18; A63G 31/00; E04H 4/14; E04H 4/129; E04H 4/143; E04H 4/145

USPC ..... 472/116, 117, 128; 4/488, 505

See application file for complete search history.

(56) References Cited

U.S. PATENT DOCUMENTS

| | | | | |
|---|---|---|---|---|
| 2,117,982 | A * | 5/1938 | Prince, Jr. | 4/505 |
| 3,757,370 | A * | 9/1973 | Seno et al. | 441/133 |
| 3,845,510 | A * | 11/1974 | Baker et al. | 4/496 |
| 4,122,560 | A * | 10/1978 | Baker | 4/505 |
| 4,707,869 | A * | 11/1987 | Ray | 4/505 |
| 5,738,590 | A * | 4/1998 | Lochtefeld | 472/117 |
| 7,547,255 | B2 * | 6/2009 | Lochtefeld | 472/90 |

* cited by examiner

*Primary Examiner* — Kien Nguyen

(74) *Attorney, Agent, or Firm* — Greenberg Traurig, LLP

(57) ABSTRACT

The invention relates to a flow divider for a sheet flow water ride having an inclined ride surface capable of dividing it into two or more sections, wherein more than one rider can then safely ride on the water ride at the same time. The water ride preferably comprises an inclined ride surface on which a sheet flow of water is propelled that substantially conforms to the contours of the ride surface. The flow divider is preferably an inflatable tube that can be extended longitudinally over the sheet flow, in substantially the same direction thereof, and float, wherein in the preferred embodiment, it is secured at its front end to the water ride and its back end is relatively free to pivot and shift from side to side, such that the momentum of the sheet flow helps to keep it oriented downstream and in the appropriate position. The air pressure in the tube is preferably adjustable to enable the divider to be inflated to the appropriate stiffness.

21 Claims, 7 Drawing Sheets

FLOW DIVIDER FOR SHEET FLOW WATER RIDES

RELATED APPLICATION

This application claims the benefit of the filing date of U.S. Provisional Application Ser. No. 61/563,265, filed Nov. 23, 2011, entitled FLOW DIVIDER FOR SHEET FLOW WATER RIDES.

FIELD OF THE INVENTION

This invention relates to a flow divider that can be positioned on the ride surface of a sheet flow water ride, such as those commonly known as the Flow Rider®, and used to separate one section of the ride surface from another. This enables more than one rider to safely ride on the water ride without the risk of interference from the other.

BACKGROUND OF THE INVENTION

Sheet flow water rides, such as those known as the Flow Rider®, typically comprise an inclined ride surface upon which a sheet flow of water under pressure is propelled at supercritical speed such that it conforms to the contours of the ride surface. The sheet flow essentially conforms to the physical shape and curvature of the ride surface, as it travels from a relatively low point to a relatively high point, such that the water takes on the shape of a wave. The depth, speed and volume of flow are preferably predetermined to maintain a consistent supercritical flow that enables the sheet flow of water to conform to the curved shape of the surface. And, with the ride surface configured with a slope or in the shape of a wave, the water ride can create simulated wave shapes similar to those that exist in nature, upon which water skimming and surfing maneuvers can be performed.

Typically, to ride this type of water ride, a rider will need to use a specially designed surfboard to maneuver on or across the moving sheet flow of water, wherein by using the force of gravity, the rider can move down and forward, and by using the rearward momentum of the sheet flow, the rider can travel up and back. By maneuvering the board in this manner, and shifting his or her weight back and forth, and staying balanced, the rider can reach an equilibrium point between the two forces and "ride the wave." By making specific adjustments, and staying balanced, etc., the rider can perform various skimming and surfing maneuvers, including cut backs, slants, jumps, etc., which can simulate the sport of surfing.

One potential drawback, however, to this type of water ride relates to its general inability to allow more than one rider to ride on it at the same time, which is a function of its size and physical limitations, etc. And, from a commercial viability standpoint, the amount of throughput that can be achieved can be a significant factor in its success.

Attempts in the past have been made to increase the size of these types of water rides, but such efforts were normally for creating larger, more advanced waves, upon which more difficult maneuvers can be performed. While these attempts enabled riders to perform advanced maneuvers, and to have advanced competitions, because not all individuals are able to acquire the skill sets necessary to perform these types of maneuvers, these types of water rides often ended up being used mostly by beginners and intermediates, in which case, they ended up not being used to their maximum potential, even though the desire to accommodate advanced riders still exists.

What is needed therefore is a device that can be used in conjunction with sheet flow water rides, which will allow more than one rider to ride on the ride surface at the same time, while promoting and maintaining safety, and can help increase throughput, and therefore, increase the commercial viability and success of the attraction.

SUMMARY OF THE INVENTION

The present invention relates to a water ride that produces a sheet flow of water under pressure having an inclined ride surface extending from a first end, having a housing with injection nozzles built in, to a second end, opposite the first end, wherein the water ride has an inclined ride surface upon which water skimming and surfing maneuvers can be performed thereon, wherein, in the preferred embodiment, a flow divider is preferably provided on the ride surface comprising an elongated inflatable tube extending substantially longitudinally downstream from the first end to the second end, wherein the divider effectively divides the ride surface into at least two sections.

One advantage provided by the present flow divider is that it enables the ride surface to be split into two or more sections, such that more than one rider can ride on the water ride at the same time (in each of the sections), without the risk of collision or interference with each other. This can be achieved by physically dividing the ride surface with an elongated inflatable tube that extends in a longitudinal direction, i.e., in the same direction as the sheet flow of water, which enables individual riders to ride on separate sections without the risk of collision or interference.

The flow divider is preferably an elongated flexible tube configured with multiple sections or bends that substantially conform to the contours of the ride surface. The divider is preferably comprised of a flexible outer layer made of durable material, such as flexible polyester-reinforced vinyl or rubber that surrounds an inner medium, such as pressurized air, although other watertight, durable and flexible materials can be used. The outer medium is preferably constructed to form a tube-like structure that becomes cylindrical when inflated with air. Alternatively, the inner medium can be comprised of foam, water, feathers, cotton, or any other material that can support its cylindrical shape while still being flexible enough to conform to the shape of the ride surface below. Note: the outer layer can be eliminated if the inner medium comprises a material that could withstand the environmental operating conditions.

The flow divider is preferably constructed using a plurality of sections that are connected or otherwise secured together, such as by heat-welding or other conventional seaming method, to form a single elongated structure. In the preferred embodiment, its shape is approximated by using straight sections, with bends or curves to form an overall curved shape. Moreover, the flexibility of the outer medium and its weight preferably help to allow the flow divider to deform properly and therefore substantially conform to the curvature of the sheet flow of water travelling on the ride surface below. The preferred tube is inflatable and buoyant such that it floats on top of the sheet flow of water on the ride surface. It can be formed with its longitudinal axis extending substantially parallel to the ride surface and therefore it can approximate the shape of the flowing water profile, wherein an optimal shape can be developed for virtually any flow profile. This way, preferably, it substantially conforms to the contours of the sheet flow of water, which helps to reduce or avoid any gaps that could otherwise form between the sheet flow, on one hand, and the flow divider, on the other hand. This can be helpful in preventing riders who have fallen from getting caught between the ride and flow divider, and/or crossing over to the other side.

In the preferred embodiment, the flow divider is connected at its front end to the nozzle housing, and the remainder of the flow divider remains substantially unsecured and relatively free to move from side to side. This allows the divider to be more forgiving in the event a rider strikes it or falls on top of it, which can reduce the chances of any injuries occurring. It also allows the divider to be lifted up by the flowing body of water, which advantageously permits the flowing body of water to travel underneath the divider, which in turn, can be helpful in reducing any boundary layer effects that can otherwise affect the quality and consistency of the sheet flow.

The connector preferably comprises two straps on either side of the front end of the flow divider, wherein the opposing ends are connected to the water ride, such as with hooks onto the grated surface on the housing deck extended above the nozzles. Preferably, each strap is independently adjustable, such as with buckles or clips, so that the length thereof can be adjusted. This way, the rotational orientation of the divider relative to the ride surface can be adjusted, simply by shortening or elongating the straps, i.e., on one side or the other, or both, whereby the orientation of the divider can be rotated and shifted from left to right, or vice verse, as desired.

Allowing the water to flow underneath the flow divider advantageously allows the energy of the flowing body of water to pass underneath, and therefore, reduce the likelihood that the divider will adversely affect the quality of the sheet flow. For example, by allowing the water to flow underneath it, potential boundary layer effects that could otherwise interfere with the flow's consistency and strength can be reduced, i.e., it can reduce the likelihood that hydraulic jumps can occur.

The divider preferably has a weight ballast on or near its back end, which is a weight that helps to limit the movement of the back end of the divider from side to side, i.e., it provides a dampening effect, wherein the divider is less likely to shift from side to side in the event a striking force acts on it, such as a rider falling. The ballast is preferably a bag that can be filled with water, or other material, and can be built internally within a cavity inside the tube, but it can also be made of any other material that can achieve the desired results. While the ballast can be mounted anywhere along the length of the divider, it is preferably positioned at the rearmost point, which provides the most effective means of dampening the side to side movement of the divider.

Preferably, the tube's stiffness can be adjusted by adjusting the air pressure within the tube. The pressure is preferably from one to five pounds per square inch, although it can be higher or lower, as needed, to provide the advantages noted herein.

Several factors can be considered in determining the proper pressure and stiffness of the tube:

First, by reducing the air pressure, the divider can become more flexible, which will allow it to sag and deform more, which is advantageous from the standpoint of enabling the divider to substantially conform to the shape of the sheet flow of water travelling on the ride surface, which can be important since the divider is preferably constructed of straight sections secured together. Reducing the air pressure also makes the divider softer and more forgiving which reduces the potential for riders to become injured in the event of a fall, etc. Also it allows the divider to absorb more energy so it doesn't shift as much when lateral forces are applied against it, such as when a rider falls, thereby reducing the possibility of interference with other riders.

Second, by increasing the pressure, and making the divider stiffer, the divider can become more buoyant, and cause it to sit up higher on the sheet flow, which can reduce the amount of drag that can otherwise affect how the sheet flow travels underneath. And by allowing it to sit up higher, it will also be easier for it to straighten back out after it is pushed to the side, i.e., such as when a rider strikes it, wherein it can pivot and swing back to its original position in response to the water flow. On the other hand, making it too stiff can increase the risk of injury, such as when a rider falls, as well as make the divider more susceptible to lateral forces, wherein the divider will then be more easily pushed from side to side.

Overall, in considering the above factors and choosing the appropriate pressure and stiffness, the goal is to reach a point where the divider is not too stiff, and not too soft, i.e., there is a proper balance between them, wherein the force of the sheet flow of water underneath it will tend to keep the divider oriented in the appropriate direction longitudinally downstream, away from the connection point, toward a point of minimum restraint, which is parallel to the direction of the sheet flow.

The present invention also comprises a method of operating a sheet flow water ride, wherein the method comprises introducing water under pressure through one or more nozzles onto the ride surface to form a sheet flow of water that substantially conforms to the shape of the ride surface, and then, extending an elongated flow divider onto the ride surface, with its front end pivotally secured to the water ride housing, and its back end extending substantially unsecured and relatively free to move from side to side, wherein the divider effectively separates the ride surface into at least two sections, to enable more than one rider to ride on it at the same time.

The method also preferably comprises securing only the front end of the divider to the water ride structure, such that the back end of the divider is substantially free to shift from side to side, wherein by allowing the divider to pivot and be acted upon by the water flow, the divider is preferably extended substantially downstream and maintained in this position over time.

The method also preferably comprises adjusting the elevation and rotational orientation of the flow divider, by adjusting the connection point to the water ride, to accommodate the depth of the sheet flow as well as to roll from left to right, or vice verse, as desired.

The method also comprises allowing the sheet flow of water to pass underneath the divider, such that undue boundary layer effects that can adversely affect the sheet flow of water are reduced.

The method also comprises adjusting the air pressure within the tube, to adjust the extent to which the tube is stiffer or softer, which can determine how the tube responds to and interacts with the sheet flow of water, i.e., whether it sits properly above the flowing body of water to eliminate any gaps that can otherwise form between the divider and water surface, and the degree to which the divider is forgiving in the event a rider falls, etc.

DETAILED DESCRIPTION OF THE INVENTION

Figure 1:
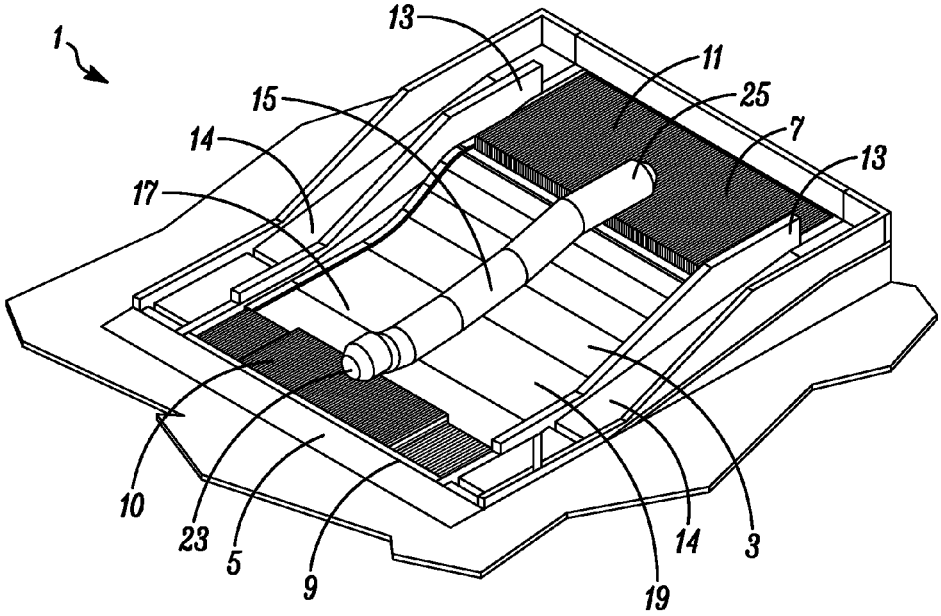
FIG. 1 shows a sheet flow water ride with an inclined ride surface thereon, wherein an inflatable flow divider is extended longitudinally from the first end to the second end, and splits the ride surface into two sections, wherein the flow divider is provided with curves and/or bends that substantially conform to the shape and curvature of the ride surface.

FIG. 1 shows a water ride attraction 1 having an inclined ride surface 3 extending substantially from a first end 5 to a second end 7. First end 5 preferably comprises a housing 9 in which at least one injection nozzle and pump are provided for injecting a sheet flow of water at supercritical speed onto ride surface 3. Housing 9 preferably comprises a deck with a grated surface 10 thereon, if desired, or other form of protective covering for the injection equipment underneath.

Second end 7 is preferably located opposite first end 5, and preferably comprises a grated surface 11 through which water flowing onto ride surface 3 can pass and be removed, wherein the water is preferably recycled back under ride surface 3, from second end 7 to first end 5, through a compartment located underneath, such that the water can be reused on ride surface 3. Preferably extended on either side of ride surface 3 are side walls 13 and walkways 14 that extend substantially from first end 5 to second end 7. Walkways 14 preferably help enable riders who exit ride surface 3 at the bottom to walk up to an entrance point on grated surface 11 along second end 7.

Inclined ride surface 3 is preferably a curved and/or inclined surface that extends upward from first end 5 to second end 7 and is preferably configured with a slope that allows the sheet flow of water traveling thereon to conform to the shape and contour thereof, to form a wave shape that simulates those that exist in nature. Preferably, inclined ride surface 3 is constructed with a padded surface with a concrete support underneath, or a fabric stretched tight across the sides to form a relatively soft and firm ride surface 3, upon which riders can maneuver without the risk of injury. Preferably, ride surface 3 is strong and durable and supports the weight of the water, as well as the riders, 20 and 22, as shown in FIG. 5.

Figure 5:
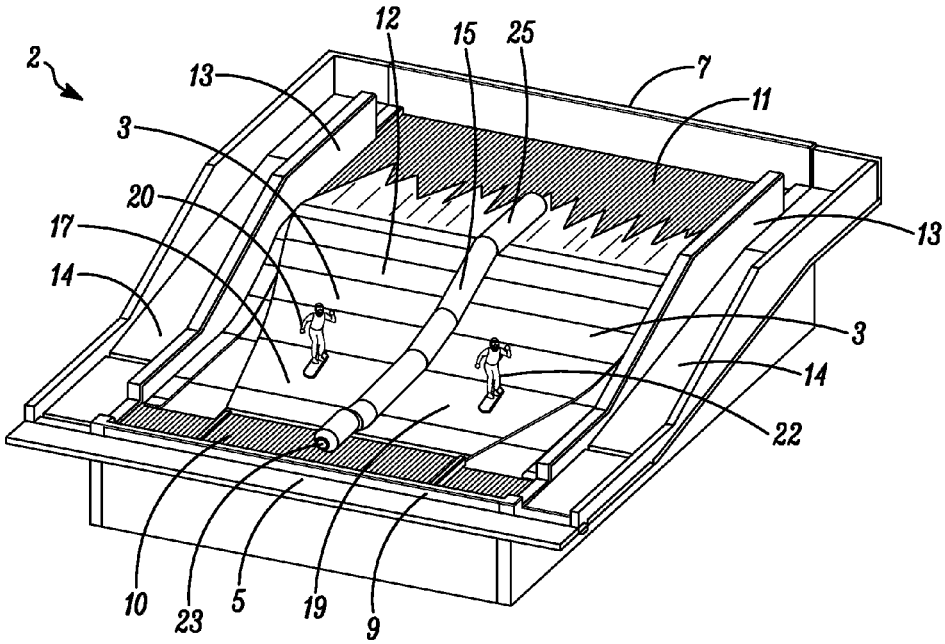
FIG. 5 shows a sheet flow water ride with an inclined ride surface in operation, wherein an inflatable flow divider is extended longitudinally from the first end to the second end, wherein the flow divider substantially conforms to the shape and curvature of the ride surface.

Ride surface 3 shown in FIG. 1 preferably extends between side walls 13, but in the embodiment of FIG. 5, ride surface 3 starts narrower, due to the injection nozzle equipment in housing 9 being narrower than ride surface 3. This way, the sheet flow of water traveling on ride surface 3 is kept substantially away from side walls 13, to reduce the boundary layer effects that can otherwise interfere with and disrupt the formation and consistency of the sheet flow of water on ride surface 3. If a sheet flow of water encounters a solid wall, the flowing water will typically slow down, thereby causing it to become sub-critical, wherein hydraulic jumps can form near the boundary layer where the water meets the wall.

In accordance with the present invention, a flow divider 15 is preferably extended on ride surface 3 substantially from first end 5 to second end 7, as shown in FIGS. 1 and 5, to divide ride surface 3 into two sections, 17, 19, wherein flow divider 15 preferably comprises an inflatable tubular member 16 that extends longitudinally downstream with its bottom substantially conforming to the shape and contour of ride surface 3. It should be noted here that other similar sheet flow water rides having various sizes and shapes are within the contemplation of the present invention, wherein one or more similar flow dividers 15 can be used to divide ride surface 3 into two or more sections, etc., if desired.

Figure 2:
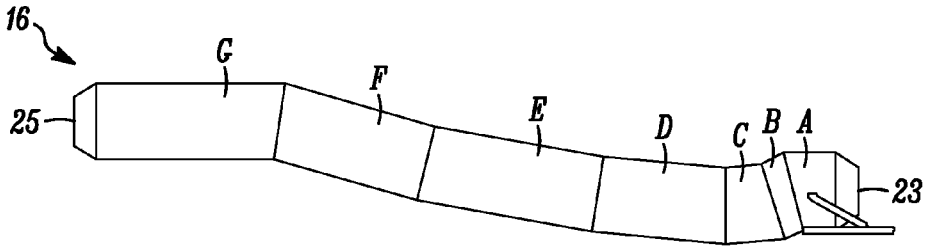
FIG. 2 is a side elevation view of the flow divider shown in FIG. 1, wherein the flow divider has sections that are secured together to form bends and/or curves that substantially conform to the shape and curvature of the ride surface.

In the preferred embodiment, flow divider 15 is preferably an elongated inflatable tube 16, as shown in FIG. 2, extending longitudinally downstream over ride surface 3, substantially from first end 5 to second end 7, and creates a physical barrier that effectively divides ride surface 3 into two sections, 17, 19. This way, more than one rider can ride on the water ride 1 at the same time, i.e., one rider can ride on section 17, and the other rider can ride on section 19, with a reduced risk of collision or injury.

As shown in FIGS. 2, 7A, 7B and 8, flow divider 15 is preferably constructed using a plurality of sections, A, B, C, D, E, F and G, secured together to form an elongated tubular structure 16 with a plurality of curves and/or bends between them. In this embodiment, flow divider 15 is preferably comprised of multiple straight sections, each made of a flat sheet of flexible material, as shown in FIGS. 9-15, that are rolled to form a tubular shape, wherein the sections are then secured together to form an elongated member 16 that substantially conforms to the shape and contour of ride surface 3, i.e., by angling each section relative to each other, a number of curves or bends can be provided along its length.

Sections A, B, C, D, E, F and G are preferably secured together, such as by heat-welding over the joints, or other conventional sealing method, such as seam tape, etc., to form a continuous elongated structure. For example, flow divider 15 can be made of multiple pieces of flexible polyester reinforced vinyl or rubber that have been heat-welded and taped or otherwise secured together using a conventional method to form an elongated structure. The material is preferably constructed in the form of sheets, as shown in FIGS. 9-15, and rolled and connected together such that they form an elongated structure which becomes cylindrical when inflated with air. And by forming tube 16 with an axis that is substantially parallel to ride surface 3, an optimal shape can be provided for the appropriate water flow profile.

Figure 9:
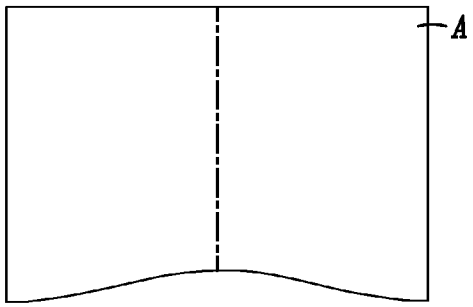
FIG. 9 is a plan view of section A which is formed from a sheet of material to make the flow divider of FIG. 8, wherein the material used is shown flat prior to being rolled and secured together with other sections to form the elongated tubular structure.
Figure 10:
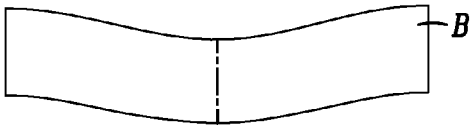
FIG. 10 is a plan view of section B which is formed from a sheet of material to make the flow divider of FIG. 8, wherein the material used is shown flat prior to being rolled and secured together with other sections to form an elongated tubular structure.
Figure 11:
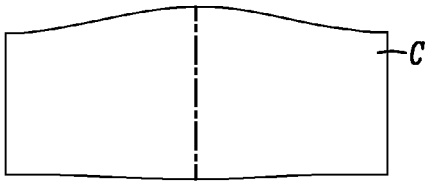
FIG. 11 is a plan view of section C which is formed from a sheet of material to make the flow divider of FIG. 8, wherein the material used is shown flat prior to being rolled and secured together with other sections to form an elongated tubular structure.
Figure 12:
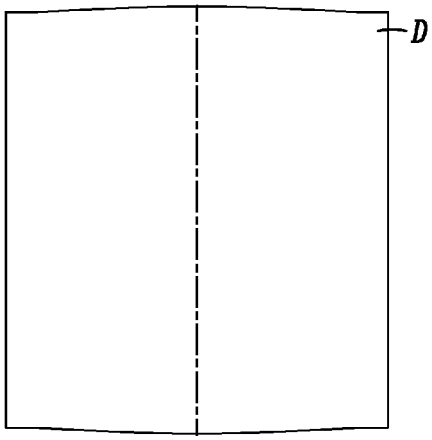
FIG. 12 is a plan view of section D which is formed from a sheet of material to make the flow divider of FIG. 8, wherein the material used is shown flat prior to being rolled and secured together with other sections to form an elongated tubular structure.
Figure 13:
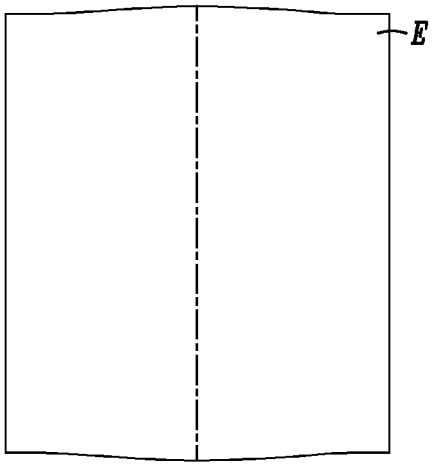
FIG. 13 is a plan view of section E which is formed from a sheet of material to make the flow divider of FIG. 8, wherein the material used is shown flat prior to being rolled and secured together with other sections to form an elongated tubular structure.
Figure 14:
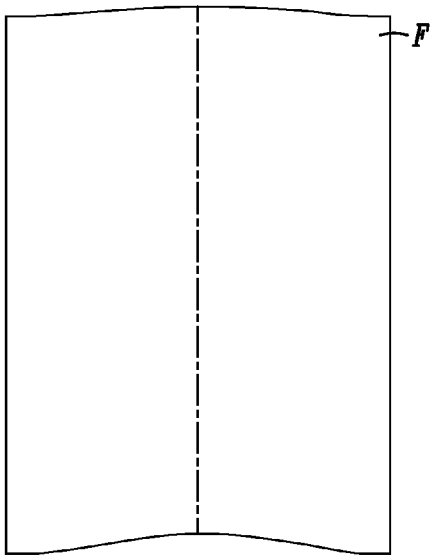
FIG. 14 is a plan view of section F which is formed from a sheet of material to make the flow divider of FIG. 8, wherein the material used is shown flat prior to being rolled and secured together with other sections to form an elongated tubular structure.
Figure 15:
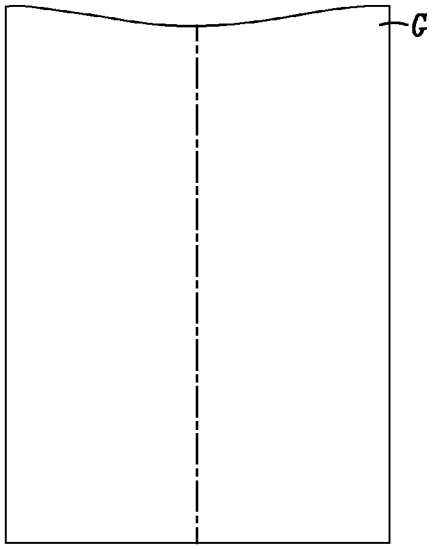
FIG. 15 is a plan view of section G which is formed from a sheet of material to make the flow divider of FIG. 8, wherein the material used is shown flat prior to being rolled and secured together with other sections to form an elongated tubular structure.
Figure 16:
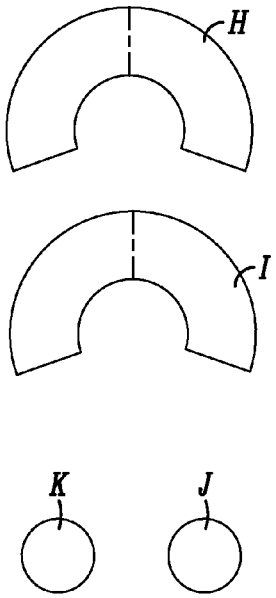
FIG. 16 is a plan view of several sections of material used to make the ends of the flow divider shown in FIG. 8.

In FIGS. 9-16, the preferred shape of each piece of material forming sections A, B, C, D, E, F, and G, is shown, wherein each is preferably pre-cut to the proper dimension and shape, such that when they are rolled and secured together they form a cylindrical tube shape, with the appropriate bends and curves between them, wherein the overall configuration is more or less like a curved tubular structure that can substantially conform to the shape and contour of ride surface 3. For example, FIG. 9 shows a sheet that forms section A, which can be rolled to form a cylindrical member at front end 23. FIG. 10 shows a sheet that forms section B, which can be rolled to form a cylindrical member between sections A and C, i.e., at an angle, downstream from front end 23. FIG. 11 shows a sheet that forms section C, which can be rolled to form a cylindrical member located adjacent section B, and FIG. 12 shows a sheet that forms section D, which can be rolled to form a cylindrical member located adjacent section C, closer to the middle. FIG. 13 shows a sheet that forms section E, which can be rolled to form a cylindrical member located adjacent section D, i.e., at a slight angle, near the center of flow divider 15, and FIG. 14 shows a sheet that forms section F, which can be rolled to form a cylindrical member located adjacent section E, along the back half of flow divider 15. FIG. 15 shows a sheet that forms section G, which can be rolled to form a cylindrical member located adjacent section F, comprising back end 23. And finally, FIG. 16 shows sections H and I, and end sections J and K, which form ends 23 and 25, located at the distal ends of flow divider 15, i.e., pieces H and I form frusto-conical shapes and circular sections J and K fill the center.

When these pieces are rolled and secured together as explained above, they can be used to form an elongated tubular structure having the appropriate bends and curves that enable it to substantially conform to the shape and contour of ride surface 3. Other means of construction including providing a single curved elongated tubular member, etc., or one filled with or made of foam or other flexible material can also be provided.

Figure 7A:
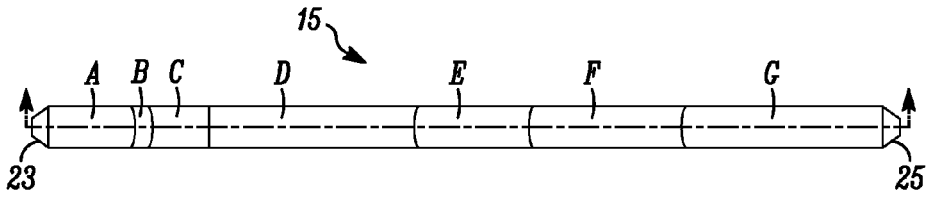
FIG. 7A is a plan view of the flow divider of FIG. 5, wherein the flow divider is shown as a single elongated structure.
Figure 7B:
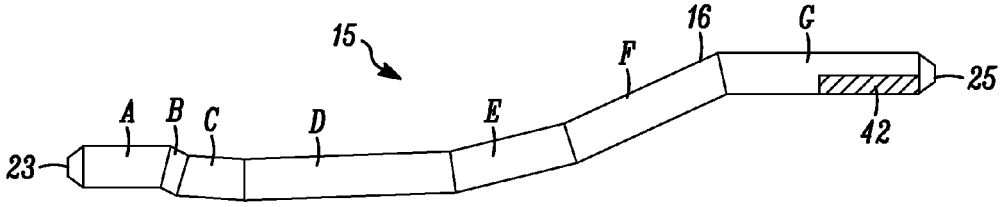
FIG. 7B is a side elevation view of the flow divider of FIG. 5, wherein the flow divider is shown with various curves and/or bends that enable it to substantially conform to the shape and curvature of the ride surface, wherein a bladder acting as a weight ballast is provided at the back end of the flow divider.
Figure 8:
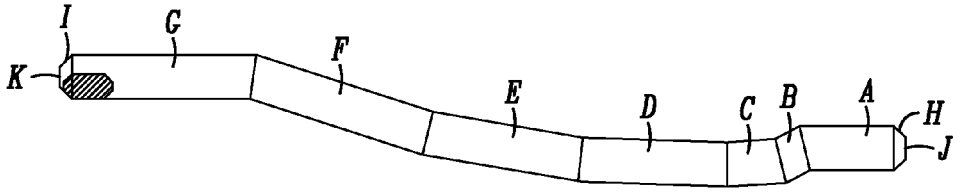
FIG. 8 is a side elevation similar to FIG. 7A, identifying the various sections that are secured together to form a single elongated structure.

In the example of FIGS. 7A and 7B, front end 23 of flow divider 15 has a front section A that is raised and extended upward, relative to sections B, C and D, with section B forming a bend in between, such that flow divider 15 substantially conforms to housing 9, which is also raised. Extended further downstream—from left to right—section D is preferably connected to section E, and section E is preferably connected to section F, which form a slope upward to better conform to the slope of ride surface 3. Then, at the top, located at back end 25, section F is preferably connected to section G, which preferably becomes level to accommodate grated surface 11 on second end 7.

A ballast 42 is preferably located inside section G, along back end 25, and preferably comprises a bag filled with water or other weighted material located internally within tube 16. Ballast 42 preferably functions as a weight that helps to limit the movement of back end 25 from side to side during operation, i.e., it helps to dampen the lateral movement of back end 25. At the same time, the weight of ballast 42 is preferably not too heavy such that it allows flow divider 15 to shift, if necessary, to some degree, such that, in the event a rider wipes out, and falls, flow divider 15 will be able to forgive some of the force by shifting sideways. And because back end 25 is not secured to ride surface 3, it advantageously allows the fallen rider to be swept back downstream and will not get caught by any securing mechanism. While ballast 42 can be mounted anywhere along the length of flow divider 15 other than front end 23, it is preferably located at the rearmost point thereof, i.e., at back end 25, to provide the most effective means of dampening the side to side movement of flow divider 15.

Because in the preferred embodiment the overall shape of flow divider 15 is determined by the use of straight sections secured together, it is the flexibility of the materials that preferably allows flow divider 15 to substantially conform to the shape and contour of ride surface 3, and therefore, the sheet flow of water thereon. Preferably, flow divider 15 is made of flexible sheets of material such as polyester reinforced vinyl, or rubber, or Hypalon, or virtually any durable and flexible airtight material, that are rolled, formed and secured together, into a tubular shape, to form an inflatable tube 16. Because flow divider 15 is substantially soft and flexible the likelihood of injuries occurring in the event of a fall, etc., can be reduced.

Figure 19:
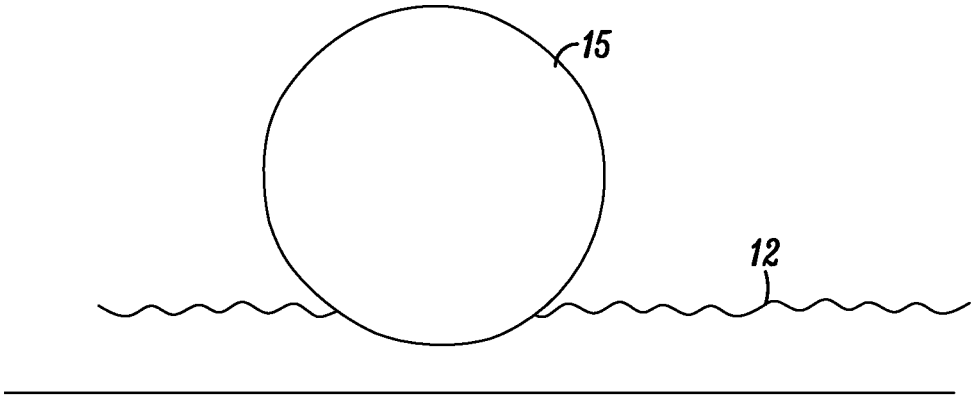
FIG. 19 is an end elevation view showing the flow divider of FIG. 5 floating on a sheet flow of water, wherein this embodiment is shown inflated to a relatively high pressure.
Figure 20:
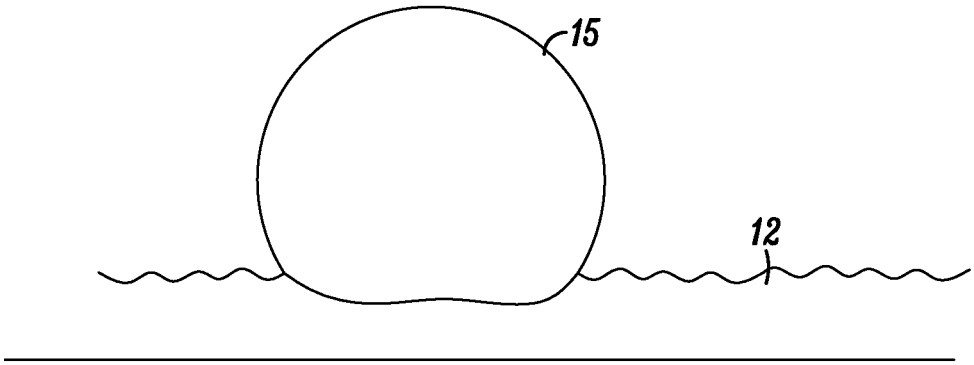
FIG. 20 is an end elevation view showing the flow divider of FIG. 5 floating on a sheet flow of water, wherein this embodiment is shown inflated to a moderately low pressure.

Flow divider 15 is preferably constructed such that it is inflatable and buoyant and floats on top of the sheet flow of water surface to help eliminate any gaps that might otherwise exist between flow divider 15 and the sheet flow below. This way, riders and their boards are prevented from accidentally getting caught underneath and between flow divider 15 and ride surface 3. Also, by floating on the water surface, as shown in FIGS. 19 and 20, flow divider 15 preferably allows the water flowing underneath it to travel freely, without being substantially interfered with or negatively impacted, while the sheet flow of water 12 travels on ride surface 3. Accordingly, flow divider 15 does not form what would be tantamount to a solid wall or other boundary layer which can otherwise adversely affect the formation and consistency of the sheet flow. A solid wall normally creates friction that can reduce the speed of flow adjacent to it, wherein boundary layer effects, such as hydraulic jumps, can alter the flow's characteristics, thereby making it difficult to maintain its consistency and shape. With a solid wall, the water closest to the boundary layer will begin to slow down and travel at less than supercritical speed, in which case, adverse boundary layer effects can form, thereby making it difficult for riders to successfully maneuver and ride on the water flow.

Preferably flow divider 15 comprises an air impervious outer layer which surrounds an inner medium, wherein the inner medium is pressurized air, but in other embodiments, the inner medium can be foam, feathers, cotton, or any other material that can provide support thereto, while still allowing enough flexibility to allow it to conform to the shape of the sheet flow of water below. Note that the outer layer can be eliminated altogether if the inner medium is made of a material that itself withstands the environmental operating conditions impacting the water ride.

Figure 6:
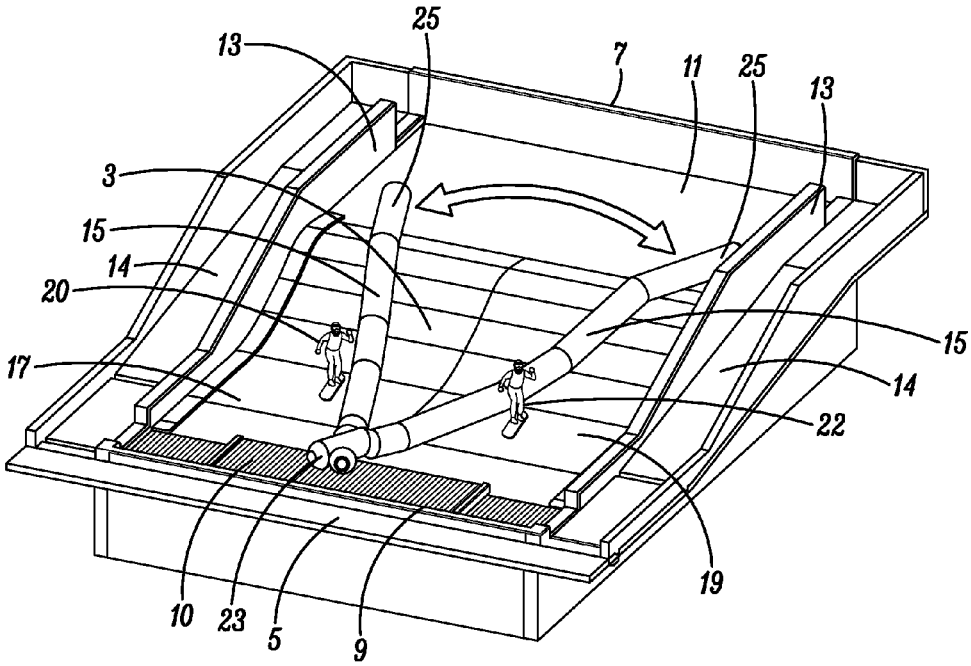
FIG. 6 shows the water ride of FIG. 5 in operation, wherein the flow divider is shown connected at its front end to the ride surface, wherein its back end pivots back and forth from side to side on the ride surface.

Another feature that helps to allow the sheet flow of water 12 to travel freely underneath flow divider 15 and thereby reduce the boundary layer effects is the manner in which flow divider 15 is restrained at front end 23, and is allowed to pivot back and forth about its connection point, while at the same time, the remainder of flow divider 15 including its back end 25 is relatively free to shift from side to side, as shown in FIG. 6. In this respect, it should be noted that the force of the sheet flow of water beneath flow divider 15 preferably causes it to be pulled downstream, away from the point of restraint, to a point of minimum frictional force, which, in this example, is in a direction away from first end 5 and toward second end 7, which results in flow divider 15 extending substantially longitudinally in the direction and orientation shown in FIG. 1.

With restraint at front end 23, the momentum created by the sheet flow preferably causes flow divider 15 to be pulled longitudinally and extended downstream, i.e., in a direction parallel to the downstream direction of sheet flow of water 12. Although there may be a tendency for flow divider 15 to roll and shift out of its path due to lateral forces being applied against it, such as when a rider wipes out and falls on top of it, under normal circumstances, the sheet flow of water will have sufficient force to cause flow divider 15 to be pulled downstream, such that the direction in which flow divider 15 will be maintained will be more or less parallel to the travel direction of the sheet flow.

Preferably, flow divider 15 is connected at its front end 23 to housing 9, and is relatively free to move from side to side along the length thereof, wherein flow divider 15 can move from side to side downstream along back end 25. While back end 25 can move from side to side, the force of the flowing water beneath divider 15 preferably helps to extend flow divider 15 longitudinally away from the point of restraint, to a point of minimum frictional force, due to the flow of water underneath, wherein the force tends to pull the flow divider in a direction that is substantially parallel to the travel direction of the water flow. Keeping back end 25 of flow divider 15 unsecured and relatively free to move advantageously reduces the risk of a rider falling and getting trapped and caught underneath. Note: if it is secured at back end 25, such as with another strap, a fallen rider could potentially get swept back and entangled by the strap.

Figure 3:
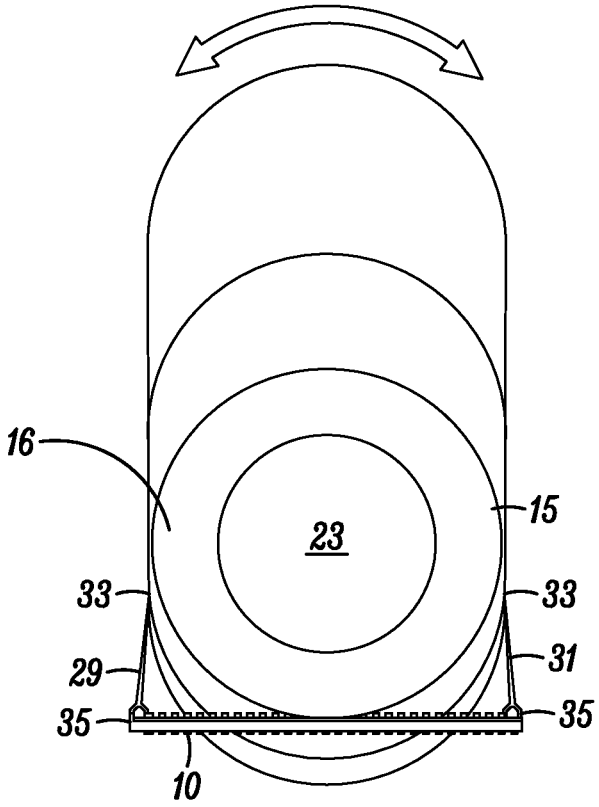
FIG. 3 is an end elevation view of the flow divider shown in FIG. 1, wherein the flow divider is shown with a connector strap on both sides, wherein each strap is capable of being independently adjusted (shortened or elongated) and can be used to elevate, rotate and shift the flow divider relative to the ride surface.
Figure 4:
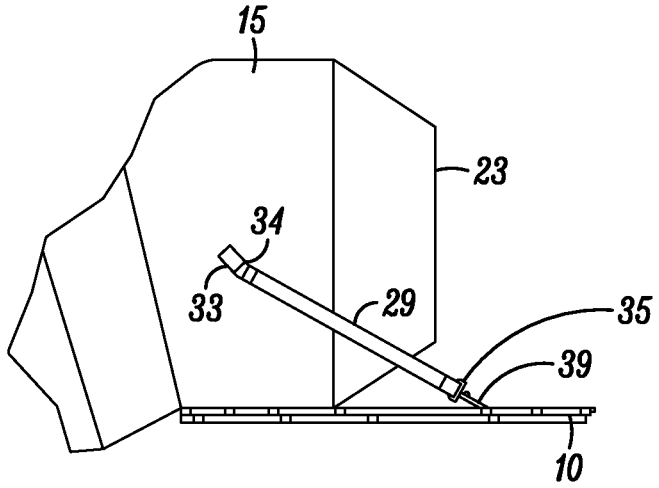
FIG. 4 is a detail of the front end of the flow divider shown in FIG. 1, wherein the flow divider is secured at its front end to the water ride structure using two adjustable connector straps anchored to the ride structure.

Preferably, the restraint or connector that secures front end 23 of flow divider 15 to water ride 1 is made adjustable in length so that the elevation of flow divider 15 can be adjusted relative to the sheet flow, to accommodate variations in the flow depth of the sheet flow, wherein this enables the position and orientation of flow divider 15 relative to ride surface 3 to be adjusted if necessary. In the preferred embodiment, the restraint system preferably comprises a pair of adjustable straps 29, 31, as shown in FIGS. 3 and 4, wherein each strap is preferably connected at its upper end 33 to flow divider 15, via a D-ring, or loop 34, etc., and at its lower end 35, to housing 9 on the water ride structure. In this case, housing 9 upon which straps 29, 31 are fastened preferably comprises a grated surface 10, which preferably extends over and across housing 9, with injection nozzles and pump located below, along first end 5. A mounting hook 39, as shown in FIG. 4, is preferably extended into the bars or members within grated surface 10, to fasten lower end 35 of each strap 29, 31 thereto.

Straps 29, 31 are preferably adjustable, with buckles, or webbing clips, etc., so that flow divider 15 can be positioned closer or further away from ride surface 3, depending on the depth of the sheet flow of water thereon, which can be from one inch to several inches or more, and other conditions on ride surface 3. For example, by lengthening straps 29, 31, flow divider 15 can be elevated to float on top of the sheet flow, until it reaches an equilibrium point, whereas, by shortening straps 29, 31, flow divider 15 can be brought down toward ride surface 3, i.e., when the flow depth is low.

Straps 29, 31 are preferably independently adjustable, such that each side can be independently elongated or shortened, as needed. For example, straps 29, 31 can be constructed with buckles or webbing clips or other adjustment mechanisms, similar to the way a belt, or straps on backpacks might be constructed, wherein by adjusting the length of each strap 29, 31, the rotational orientation of tube 16 can be adjusted. For example, by lengthening strap 29 on one side, and shortening strap 31 on the other side, flow divider 15 can be rotated clockwise, such that it will roll to the right, while, by lengthening strap 31 and shortening strap 29, flow divider 15 can be rotated in the other direction, i.e., counter clockwise, such that flow divider 15 will roll to the left (both directions are shown by the arrow in FIG. 3). It can be seen that by shortening the strap on one side, and/or lengthening the strap on the other side, tube 16 can be oriented more to one side or the other, which directly affects the way it will rest on ride surface 3, i.e., whether it is pulled to the left or right, as shown in FIG. 6.

By making these adjustments, the extent to which flow divider 15 is allowed to elevate up and down in response to the depth of the sheet flow of water and the way it rotates can be predetermined and adjusted. Moreover, when rotating flow divider 15 in this fashion, the lateral orientation thereof relative to ride surface 3 can be adjusted when desired, such as from side to side, as shown in FIG. 6.

FIG. 5 shows a containerless ride surface 3 wherein the injection means within housing 9 is narrower than ride surface 3, such that the flowing body of water formed on ride surface 3 does not substantially make contact with side walls 13 until substantially downstream toward second end 7. That is, by injecting sheet flow of water 12 with a width that is narrower than the width of ride surface 3, the sheet flow will stay substantially away from side walls 13, and therefore, undue friction will not be created along the sides, and therefore, adverse boundary layer effects can be reduced which can otherwise adversely affect the speed, formation and consistency of the sheet flow.

FIG. 5 shows riders 20 and 22 riding on sections 17 and 19 of ride surface 3 simultaneously, with flow divider 15 extended in between them, acting as a physical barrier in the center of ride surface 3. This way, as riders 20, 22 maneuver on ride surface 3, the risk of collision or interference with each other can be reduced. The sheet flow 12 is preferably adapted to flow from housing 9 on front end 5 toward grated surface 11 along back end 7, up and across inclined ride surface 3. The sheet flow 12 preferably widens from the relatively narrow housing 9, toward second end 7.

Flow divider 15 is preferably about 15 to 50 inches in diameter, although it can be larger or smaller, if desired. In this respect, it should be large enough so that it provides a physical barrier between sections 17, 19, to prevent riders from crossing and tripping over it. At the same time, it should be small enough so that it doesn't consume too much of the ridable space on ride surface 3.

The preferred length of flow divider 15 simply depends on the size of ride surface 3. Preferably, flow divider 15 is pivotally connected to ride surface 3 on or near housing 9, at first end 5, with front end 23 extended above housing 9, as shown in FIGS. 1 and 5, although not necessarily so. By keeping the restraining point upstream, the momentum of the sheet flow will tend to pull flow divider 15 in a downstream direction, which helps keep it oriented properly as shown. Back end 25 of flow divider 15 is preferably extended up and beyond ride surface 3, and onto grated surface 11, such that ballast 42 helps to keep back end 25 weighted down and rested on top of grated surface 11. This not only helps pre-vents back end 25 from shifting from side to side, but by positioning ballast 42 over grated surface 11, water flowing underneath flow divider 15 will have a chance to clear out through grated surface 11 before being interfered with by ballast 42 acting on flow divider 15. Stated differently, if the ballast 42 rested on top of ride surface 3, ballast 42 would cause flow divider 15 to be weighed down at that point, wherein, flow divider 15 could then interfere with the free movement of the sheet flow underneath. But by extending ballast 42 over grated surface 11, its weight will not adversely affect the flow of water underneath flow divider 15, and therefore, it will not negatively affect its ability to clear water through grated surface 11. If ballast 42 was located closer to front end 23, it could potentially cause flow divider 15 to rest directly on top of ride surface 3, and thereby, prevent water from flowing underneath it, which in turn, can potentially create undesirable boundary layer effects, as discussed.

The amount of air pressure within divider 15 is preferably made adjustable which can substantially affect the performance thereof. When air pressure is relatively low, as shown in FIG. 20, flow divider 15 will tend to sag and deform, which can allow it to conform better to the contour of ride surface 3 and therefore the water flow profile. It will also enable flow divider 15 to absorb more energy and be more flexible so that it can bend or kink better such as when a rider runs into it, which makes it safer to use. At the same time, if flow divider 15 is deflated too much, it can become too flat, wherein more boundary layer effects may be introduced into the sheet flow. That is, if flow divider 15 sags too much, there will be an increased surface area of contact between the water, on one hand, and flow divider 15, on the other hand, which may increase drag, which can then interfere with the free flow of water underneath it, and therefore, impact the speed and quality of the sheet flow.

On the other hand, when air pressure is higher, flow divider 15 will be stiffer, which will cause it to float and ride higher on top of the water surface, as shown in FIG. 19. This will allow it to react more to the forces acting on the side thereof, such as when water flows against it, thereby making it more likely that it can straighten back out when struck and pushed to the side, i.e., it can swing back and pivot about the connection point until its longitudinal orientation is restored. Inflating flow divider 15 with more air pressure will also increase its buoyancy, which means it will tend to float higher on top of the sheet flow, and therefore, be subject to the influences thereof, although if it is too stiff, it can increase the risk of injury when a rider falls.

The preferred air pressure takes into account the above factors and is about one to five pounds per square inch. This preferably gives flow divider 15 the right combination of rigidity and flaccidity, wherein, the pressure is preferably high enough for it to remain sufficiently buoyant and hold a tubular shape, such that it rides on top of the sheet flow to avoid the boundary layer effects that can otherwise be detrimental to the sheet flow, but at the same time, the pressure is low enough such that flow divider 15 will sag and deform slightly, wherein its weight and flexibility will help it substantially conform to the shape and contour of ride surface 3, thereby helping to avoid any gaps that may otherwise form between flow divider 15 and the water flow. It will also be better able to absorb the impact and energy of any forces that may be applied against it, wherein the risk of injury can be reduced thereby, i.e., by making the tube softer and more forgiving, etc. Making flow divider 15 softer will also reduce the tendency for it to roll or rotate and deviate from its intended orientation relative to the travel direction of the water flow.

Figure 17:
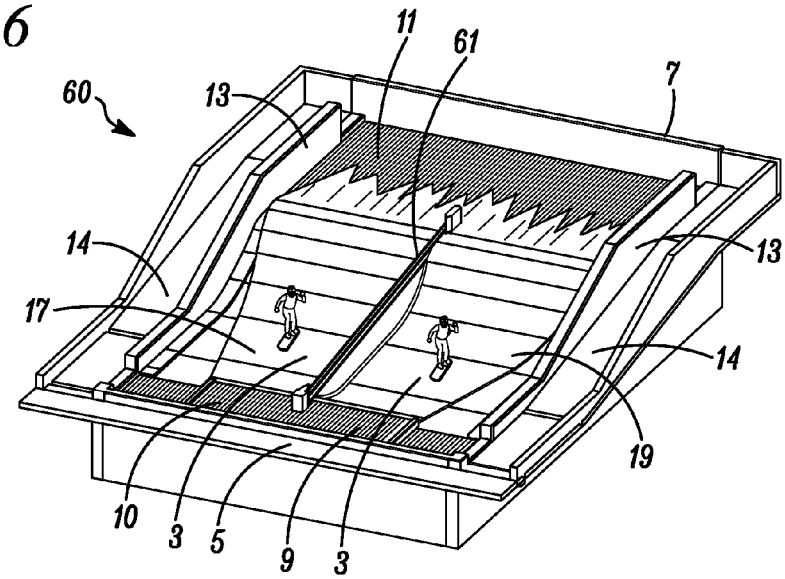
FIG. 17 shows another embodiment of the present invention with an inclined ride surface, wherein a flow fence is extended longitudinally from the first end to the second end, and splits the ride surface into two sections.
Figure 18:
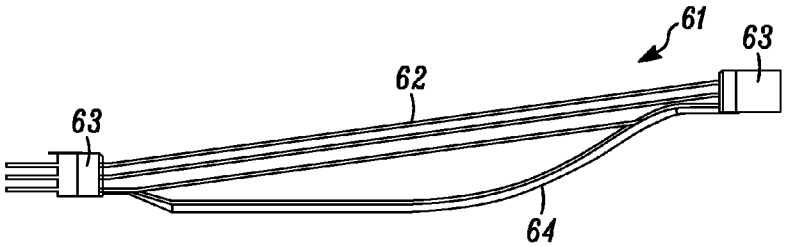
FIG. 18 is a side elevation of the embodiment of FIG. 17, wherein the flow fence is extended longitudinally from the front end to the back end, and has a lower section that substantially conforms to the shape and curvature of the ride surface.

FIGS. 17 and 18 show an alternate embodiment 60 with a flow barrier that comprises a longitudinally oriented fence 61, which helps divide ride surface 3 into two sections 17 and 19. As with the embodiment of FIG. 5, this sheet flow water ride attraction comprises a ride surface 3, with housing 9 and grated surface 10 thereon, along first end 5, wherein ride surface 3 is sloped and extends upward toward second end 7, wherein a grated surface 11 is provided along second end 7, and a sheet flow of water can be injected on ride surface 3 that travels from first end 5 to second end 7.

In this embodiment, flow fence 61 is preferably composed of flexible bands of material 62, as shown in FIG. 18, suspended and pulled tightly between two posts 63 which are affixed to ride structure 3 on opposite ends. The bottom of material 62 is preferably filled with water or other weighted material to help it conform to the contour of ride surface 3, i.e., by virtue of the weight of bladder 64 affixed or attached to the bottom of material 62. While this embodiment allows fence 61 to substantially follow the shape and contour of the sheet flow, it is limited in its ability to adapt to different depths and shapes. As such, if the water flow is pumped over a flexible stretched membrane, for example, instead of a rigid surface, or the depth of the sheet flow is altered, it may not conform properly to the shape and contour of the sheet flow, especially in the event of a large deflection or change. Accordingly, a gap can exist between the lower edge of fence 61 and the sheet flow, allowing the possibility of a rider or board to pass underneath fence 61. Moreover, if the water level extends above the bottom of fence 61, the fence 61 could interfere with the flow of water underneath.

What is claimed is:

1. A sheet flow water ride comprising:

a first end and a second end, with a nozzle housing built into said first end, and an inclined ride surface extending from said first end to said second end;

an elongated member having a front end and a back end, wherein said front end is substantially secured to said first end of said water ride, and said elongated member is extended rearward over said ride surface, substantially longitudinally toward said second end, wherein said back end of said elongated member is unsecured and relatively free to move side to side across the majority of a width of the ride surface; and a connector securing said front end of said elongated member to said first end of said water ride, wherein said elongated member remains substantially free to pivot about said connector and move from side to side across said ride surface.

2. The water ride of claim 1, wherein said elongated member is an inflatable tube made from an outer flexible medium filled with air.

3. The water ride of claim 2, wherein said tube is configured with multiple curves and/or bends which allow said tube to substantially conform to the curvature of said ride surface and of the sheet flow of water traveling on said ride surface.

4. The water ride of claim 2, wherein said tube is made of rubber or vinyl, and constructed using a plurality of straight sections secured together to form a single elongated structure.

5. The water ride of claim 2, wherein the pressure inside said tube ranges from about one psi to about five psi.

6. The water ride of claim 1, wherein said front end of said elongated member is configured to extend over said housing, and is followed downstream by a downward portion that drops down toward said ride surface, wherein said elongated member is provided with a rearward portion that substantially conforms to the upward curvature of said ride surface.

7. A sheet flow water ride comprising:

a first end and a second end, with a nozzle housing built into said first end, and an inclined ride surface extending from said first end to said second end;

an elongated member having a front end and a back end, wherein said front end is substantially secured to said first end of said water ride, and said elongated member is extended rearward over said ride surface, substantially longitudinally toward said second end, wherein said back end of said elongated member is remains unsecured;

a connector securing said front end of said elongated member to said first end of said water ride, wherein said elongated member remains substantially free to pivot about said connector and move from side to side on said ride surface; and wherein said connector comprises two straps extended on either side of said elongated member, wherein opposing ends of said straps are connected to said housing, wherein said straps are adjustable and can be independently shortened and extended to adjust the elevation and rotation of said elongated member relative to said ride surface.

8. The water ride of claim 7, wherein a weight ballast is provided on or near said back end of said elongated member such that said ballast is located above a grated surface positioned at or near said second end of said water ride.

9. A divider adapted for a sheet flow water ride to divide an inclined ride surface thereon, said divider comprising:

an elongated inflatable tube having a front end and an unsecured back end, wherein said tube is comprised of at least one bend or curve capable of enabling said tube to conform to the curvature of said inclined ride surface; and a connector for substantially securing said tube to said water ride, wherein said connector is adjustable such that the elevation of said tube relative to said inclined ride surface can be adjusted; and wherein said tube is relatively free to move side to side across said water ride.

10. The divider of claim 9, wherein said tube is constructed from an outer flexible medium filled with air, wherein said medium comprises multiple sections connected together but separated by curves and/or bends to allow said tube to substantially conform to the curvature of said inclined ride surface.

11. The divider of claim 10, wherein said multiple sections comprise a plurality of straight sections made of rubber or vinyl sheets rolled and secured together to form a single continuous elongated tubular structure.

12. The divider of claim 9, wherein said connector is adapted such that said front end of said divider is pivotally connected to said water ride.

13. The divider of claim 9, wherein the pressure inside said tube can be adjusted from about one psi to about five psi to adjust the stiffness of said tube.

14. A divider adapted for a sheet flow water ride to divide an inclined ride surface thereon, said divider comprising:

an elongated inflatable tube having a front end and a back end, wherein said tube is comprised of at least one bend or curve capable of enabling said tube to conform to the curvature of said inclined ride surface; and a connector for substantially securing said tube to said water ride, wherein said connector is adjustable such that the elevation of said tube relative to said inclined ride surface can be adjusted and is adapted such that the front end of the divider is pivotally connected to the water ride, and the back end of the tube remains unsecured and substantially free to pivot and move from side to side; and wherein said connector comprises two straps connected on either side of said tube, wherein said straps are independently adjustable and can be shortened and extended to adjust the rotational orientation of said tube relative to said inclined ride surface.

15. A divider adapted for a sheet flow water ride to divide an inclined ride surface thereon, said divider comprising:

an elongated inflatable tube having a front end and a back end, wherein said tube is comprised of at least one bend or curve capable of enabling said tube to conform to the curvature of said inclined ride surface; and a connector for substantially securing said tube to said water ride, wherein said connector is adjustable such that the elevation of said tube relative to said inclined ride surface can be adjusted; and wherein said back end of said tube comprises a bladder therein that can be filled with water that functions as a weight ballast.

16. A sheet flow water ride comprising:

an inclined ride surface extending from a first end to a second end, wherein a sheet flow of water can travel thereon from said first end to said second end;

an elongated divider having a front end and a back end, wherein said front end is secured to said first end of said water ride, and said back end is unsecured and extends rearward toward said second end, longitudinally away from said first end;

wherein said divider is adapted to substantially conform to the curvature of said inclined ride surface and the curvature of the sheet flow of water traveling thereon and is relatively free to move side to side across the inclined ride surface.

17. The water ride of claim 16, wherein said divider comprises a flexible inflatable tube made of rubber or vinyl, which is constructed using a plurality of sections secured together to form a single continuous elongated structure.

18. The water ride of claim 17, wherein said tube is buoyant such that it floats on top of the sheet flow of water on said inclined ride surface.

19. The water ride of claim 16, wherein said front end of said divider is pivotally connected to said first end of said water ride.

20. A sheet flow water ride comprising:

an inclined ride surface extending from a first end to a second end, wherein a sheet flow of water can travel thereon from said first end to said second end;

an elongated divider having a front end and a back end, wherein said front end is secured to said first end of said water ride, and said back end extends rearward toward said second end, longitudinally away from said first end; and wherein said divider is adapted to substantially conform to the curvature of said inclined ride surface and the curvature of the sheet flow of water traveling thereon; and wherein a connector is provided to secure said divider to said water ride, wherein said connector comprises two straps on either side of said divider, wherein opposing ends of said straps are connected to said water ride, and said straps are independently adjustable and can be shortened and extended to adjust the elevation and rotation of said divider relative to said inclined ride surface.

21. A sheet flow water ride comprising:

an inclined ride surface extending from a first end to a second end, wherein a sheet flow of water can travel thereon from said first end to said second end;

an elongated divider having a front end and a back end, wherein said front end is secured to said first end of said water ride, and said back end extends rearward toward said second end, longitudinally away from said first end; and wherein said divider is adapted to substantially conform to the curvature of said inclined ride surface and the curvature of the sheet flow of water traveling thereon; and wherein said back end of said divider has a bladder that can be filled with water and functions as a weight ballast.

* * * * *